United States Patent [19]

Hemphill et al.

[11] Patent Number: 4,885,889

[45] Date of Patent: Dec. 12, 1989

[54] GRID ACCENT AND CEILING BOARDS

[75] Inventors: John M. Hemphill; Ernest B. Nute, Jr., both of Lancaster, Pa.

[73] Assignee: Armstrong World Industries, Inc., Lancaster, Pa.

[21] Appl. No.: 281,635

[22] Filed: Dec. 9, 1988

Related U.S. Application Data

[63] Continuation-in-part of Ser. No. 199,799, May 27, 1988, abandoned.

[51] Int. Cl.[4] ..... E04B 5/55

[52] U.S. Cl. ..... 52/484; 52/311

[58] Field of Search ..... 52/475, 476, 477, 484, 52/665, 311

[56] References Cited

U.S. PATENT DOCUMENTS

| | | | |
|---|---|---|---|
| 3,014,564 | 5/1960 | Thomsen et al. | 52/284 |
| 3,557,513 | 2/1969 | Girard | 52/475 |
| 4,115,970 | 9/1978 | Weinar | 52/311 |
| 4,189,888 | 2/1980 | Blitzer, Jr. | 52/311 |
| 4,638,616 | 1/1987 | Fredericks | 52/475 |

*Primary Examiner*—Carl D. Friedman
*Assistant Examiner*—Michele A. Van Patten

[57] ABSTRACT

A suspended ceiling system is provided with a ceiling runner arrangement and ceiling boards positioned therein. At the intersection of four runners and ceiling boards, a cutaway area can be provided in the board structure to receive a decorative element. A new ceiling design is formed from the decorative element(s) used in conjunction with the ceiling boards.

6 Claims, 2 Drawing Sheets

GRID ACCENT AND CEILING BOARDS

CROSS-REFERENCE TO RELATED APPLICATION

This application is a continuation-in-part of U.S. Ser. No. 199,799, filed May 27, 1988 on the "Grid Accent and Ceiling Boards" invention herein.

BACKGROUND OF THE INVENTION

1. Field of the Invention

The invention is directed to a suspended ceiling system and, more particularly, a suspended ceiling system wherein a decorative element is provided on the grid structure to form a ceiling design in conjunction with the ceiling boards.

2. Description of the Prior Art

U.S. Pat. No. 4,115,970 broadly suggests the use of decorative elements fastened to runner intersections at the corners of ceiling boards.

U.S. Pat. No. 4,189,888 suggests the use of recessed corner areas in ceilings.

The prior art fails to teach the use of tegular ceiling boards with certain of the ceiling boards having their corners cut away and a deocrative element inserted in the cutaway areas and fastened to the intersection of the runners to form a unique ceiling design composed of ceiling boards and accent elements.

SUMMARY OF THE INVENTION

A suspended ceiling is provided with the conventional network of ceiling runners. Ceiling boards are positioned in the ceiling runner system and the ceiling boards are tegular ceiling boards which have grooves along the edges of the ceiling boards to permit the finished surface of the ceiling boards to rest below the plane of the horizontal flanges of the ceiling runners. At the intersection of four ceiling boards and ceiling runners, a portion of the ceiling boards are cutaway to make the cutaway area of the ceiling boards with a bottom region in the plane of the ceiling runners. A deocrative element for accent purposes is then positioned in the cutaway area and is fastened to the intersection of the grid runners. This then provides a small decorative element positioned at the intersection of the four adjacent ceiling boards.

DESCRIPTION OF THE PREFERRED EMBODIMENT

A suspended ceiling system 2 is formed comprising a network of ceiling runners 4 which are formed in a goemetric pattern which is normally a rectalineal pattern. Each of the runners has an inverted T-shape with a vertical web 6 and a horizontal flange 8 which extends to either side of the vertical web. The exact shape of the runner is not critical to the invention.

Figure 1:
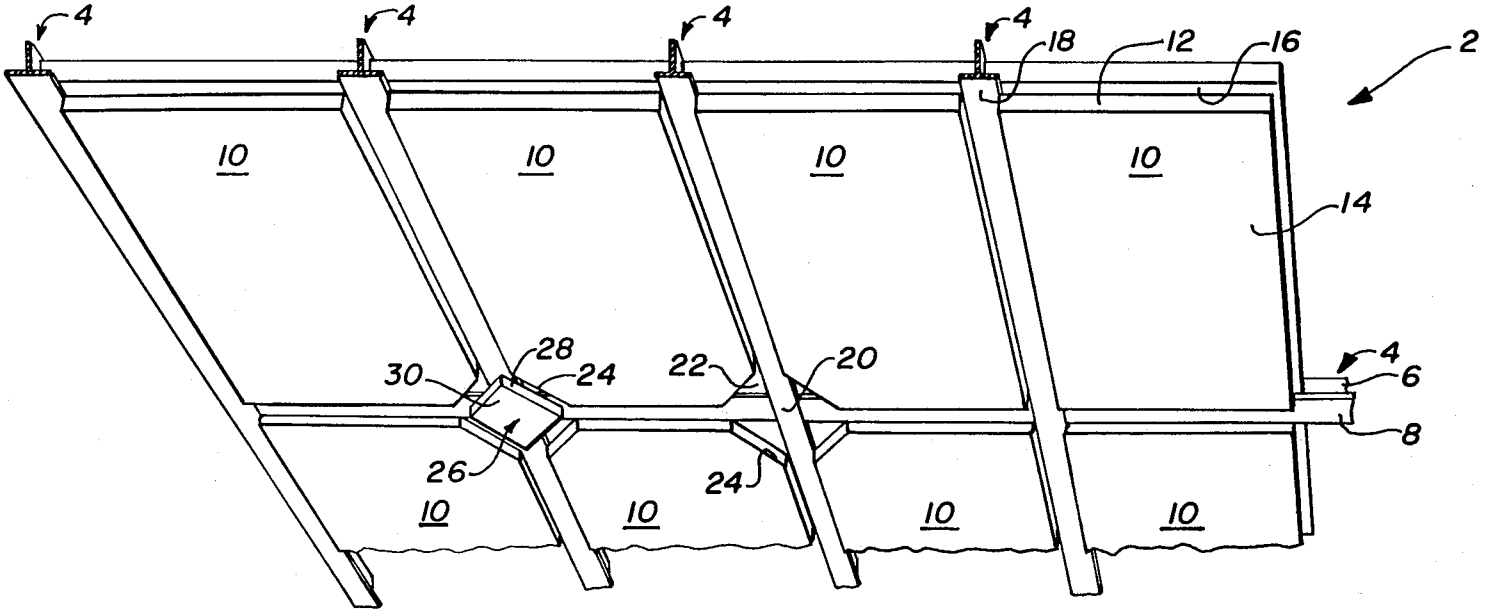
FIG. 1 is a perspective view of a suspended ceiling system containing ceiling boards with cutaway areas at their intersection and a decorative element being placed in the cutaway areas.

A plurality of ceiling boards 10 are provided and positioned within the runners. The ceiling boards are provided with a tegular edge structure. The tegular edge structure requires that the ceiling boards be provided with a recessed groove means 12 around the periphery thereof. This forms a finished surface 14 for the ceiling board and a surface 16 which will rest on the horizontal flanges 8 of the ceiling runners to support the ceiling board in position on the horizontal flanges of the runners. The plane of the finished surface 14 is below the plane of the lower surface 18 of the ceiling runners as particularly seen in the upper right portion of FIG. 1 where the surface 18 of the runner is identified. There can clearly be seen there the fact that the finished surface 14 is in a plane below the plane of the horizontal runner surface 18. As best seen in the middle of FIG. 1, the runners 4 intersect in a right angle intersection at point 20 and at every other intersection point in the ceiling runner system. At the point 20 on all of the intersections of the runners or just selected intersections of the runners, the ceiling board is formed with a cutaway area as shown in the vicinity of point 20, FIG. 1. It can be seen that the bottom of the cutaway area 22 of one of the ceiling boards is in substantially the same plane as the surface of the horizontal flange of a runner. Thus, at the intersection point 20, each of the boards at that intersection is cutaway and each of the ceilings boards is formed with an edge 24 and a bottom 22 at the cutaway portion. Thus, there is formed 4 edges 24, one for each of the four ceiling boards, and within the four edges there is formed a bottom 22, containing substantially in one plane, the horizontal flanges of the intersecting runners and the bottom of the cutaway portions of each of the four boards. This forms what is called "a cutaway area" of the four adjacent boards.

Figure 5:
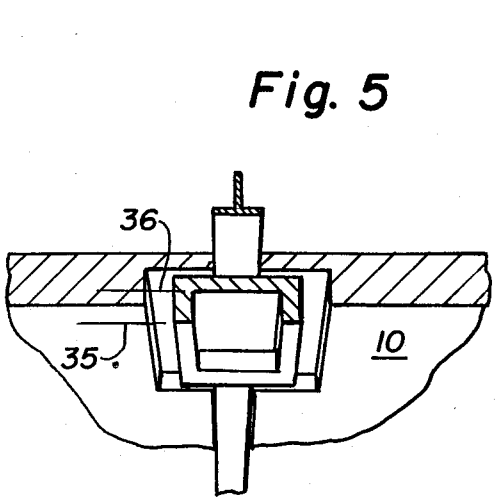
FIG. 5 is another embodiment of the decorative element.
Figure 4:
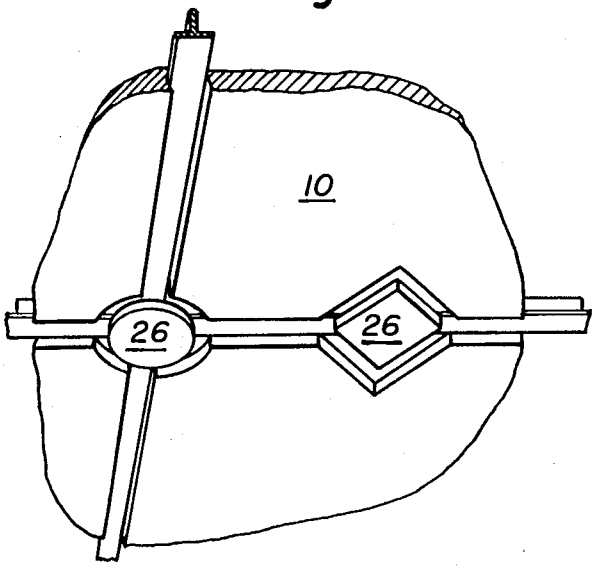
FIG. 4 is two other embodiments of the decorative element.

On the right side of FIG. 1, a decorative element 26 is inserted into this cutaway area. The element or insert 26 is generally square in shape and has side walls or edges 28 and a finished surface 30. As shown in FIG. 4 the element 26 is circular. Other shapes or sizes can be used. When the insert is placed in the cutaway area, it is fastened to the intersection of the ceiling runners and the edges 28 of the insert are spaced from the edges 24 of the ceiling boards to provide an open area therebetween. The surface 30 of insert may be the same coloration or a contrasting coloration, or same texture or different texture, to that of the finished surface 14 of the ceiling boards. Both the surface 30 and the surface 14 are shown as being in the same plane and this is the preferred embodiment. However, it could be possible for the insert to be made so that the plane of its surface 30 is above or below the plane of the ceiling board 14. As shown in FIG. 5, part of the element 26 is above the plane of the boards as shown by surface 35, whereas surface 36 is below the plane of the boards. Clearly, the insert has its dimensions from side to side smaller than the dimensions across the cutaway area so that the edges 24 of the cutaway area are spaced from the edge 18 of the insert and there is formed a space or groove effect therebetween. However, if the edge 24 of the ceiling board 10 and the edge 28 of the insert 26 are formed with some structure other than a square edge, for example, a curved edge or a stepped edge, then the edge of the insert and the edge of the cutaway area could abut at some point and still provide a decorative groove effect between the two edges.

Figure 2:
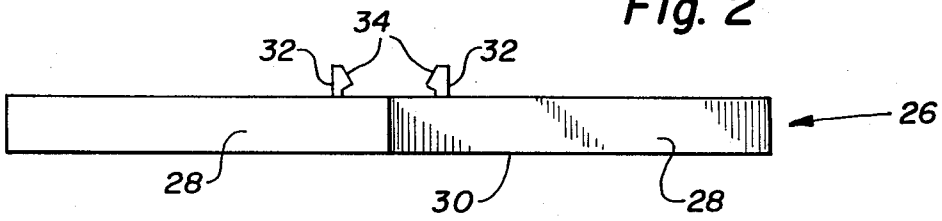
FIG. 2 is a side view of a decorative element showing its mounting structure.

As shown in FIG. 2, there is a side view of the insert 26 showing the edge 28 and the surface 30. Projecting upward from the center region of the insert 26 are four fingers 32 with hooked ends 34. The hooked ends all face towards the center of the insert and the hooked ends snap over the edges of the horizontal flange 8 of one or both of the ceiling runners to hold the insert in place in the cutaway area.

Figure 3:
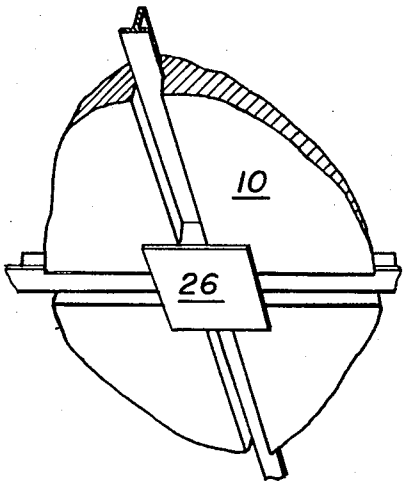
FIG. 3 is another embodiment of the decorative element.

As shown in FIG. 3, the insert 26 is located at the intersection of four boards, but no groove is provided between the edge of the insert and the edge of the cutaway area of the board. On the left hand side of FIG. 4, the insert 26 has a circular shape.

As shown on the right hand side of FIG. 4, the insert 26 is located, not at the intersection of four boards and four runners, but in a cutaway area along one runner and extending into at least one board and preferably two boards. The insert 26 is fastened to the runner by the fingers 32 of FIG. 2. With both insert shapes and locations shown in FIG. 4, a groove is positioned around the insert, but this is not necessary, but only preferable at present.

Finally, FIG. 5 shows an insert with a recessed surface. The recessed surface is below the plane of the ceiling boards (see line 36) while part of the insert is above the plane of the ceiling boards (see line 35). The invention herein is in no way limited to a flat surface 30 positioned only in the plane of the ceiling boards.

What is claimed is:

1. A suspended ceiling system comprising:

(a) a network of ceiling runners formed in a geometric pattern, each runner being of a generally inverted T-shape with a vertical web and a horizontal flange extending to either side of the vertical web;

(b) a plurality of ceiling boards with edges and a finished surface, said boards being positioned and supported on their edges on the horizontal flanges of the ceiling runners, each edge of the board having a recessed groove means forming a surface to support the ceiling board on the runner with the finished surface of the board positioned below the horizontal flanges of the runners;

(c) the ceiling runners forming at least one intersection where four runners form a right angle intersection of the four runners;

(d) the improvement comprising:

(i) there being at least one intersection of the four runners, the four adjacent ceiling boards at the intersection being formed each with a cutaway area that has at least one edge and a bottom that is positioned generally in the plane of the horizontal flanges of the ceiling runners; and (ii) an insert having at least one edge and a finished surface positioned in said cutaway area of the four adjacent boards, said insert being generally smaller than said cutaway area so that said edge of said insert is spaced from said edges of the cutaway area, and said finished surface of the insert being substantially in the same plane as the finished surface of the ceiling boards.

2. The suspended ceiling system of claim 1 wherein the insert may be of different shapes and sizes.

3. The suspended ceiling system of claim 1 wherein the insert is the same size as the cutaway area so that the edge of the insert abuts the edges of the cutaway area.

4. The suspended ceiling system of claim 1 wherein the finished surface of the insert is above, below, or both above and below the plane of the finished surface of the ceiling boards.

5. A suspended ceiling system comprising:

(a) a network of ceiling runners formed in a geometric pattern, each runner being of a generally inverted T-shape with a vertical web and a horizontal flange extending to either side of the vertical web;

(b) a plurality of ceiling boards with edges and a finished surface, said boards being positioned and supported on their edges on the horizontal flanges of the ceiling runners, each edge of the board having a recessed groove means forming a surface to support the ceiling board on the runner with the finished surface of the board positioned below the horizontal flanges of the runners;

(c) each ceiling runner having at least two ceiling boards adjacent thereto with one of the adjacent boards being on one side of the vertical web of the runner and the second adjacent board being on the other side of the vertical web of the runner;

(d) the improvement comprising:

(i) there being formed a cutaway area in at least one board, said cutaway area has at least one edge and a bottom that is positioned generally in the plane of the horizontal flanges of the ceiling runners; and (ii) an insert having at least one edge and a finished surface positioned in said cutaway area of the boards, said insert being generally smaller than said cutaway area so that said insert will fit in the cutaway area, and said finished surface of the insert being substantially in the same plane as the finished surface of the ceiling boards.

6. A suspended ceiling system as set forth in claim 5 wherein:

(a) the cutaway area spans both boards and the insert extends across the runner into both board cutaway areas.

* * * * *